US009902193B2

(12) United States Patent
Kim

(10) Patent No.: US 9,902,193 B2
(45) Date of Patent: Feb. 27, 2018

(54) PICTURE USING SALT AND MANUFACTURING METHOD THEREFOR

(71) Applicant: Tae Eun Kim, Seoul (KR)

(72) Inventor: Tae Eun Kim, Seoul (KR)

( * ) Notice: Subject to any disclaimer, the term of this patent is extended or adjusted under 35 U.S.C. 154(b) by 0 days.

(21) Appl. No.: 15/114,452

(22) PCT Filed: May 11, 2015

(86) PCT No.: PCT/KR2015/004663

§ 371 (c)(1),
(2) Date: Jul. 27, 2016

(87) PCT Pub. No.: WO2016/076492

PCT Pub. Date: May 19, 2016

(65) Prior Publication Data

US 2016/0347116 A1 Dec. 1, 2016

(30) Foreign Application Priority Data

Nov. 10, 2014 (KR) ..... 10-2014-0155392

(51) Int. Cl.

| | |
|---|---|
| ***B05D 3/02*** | (2006.01) |
| ***B44D 2/00*** | (2006.01) |
| ***B05D 3/00*** | (2006.01) |
| ***B44D 3/18*** | (2006.01) |
| ***B44C 3/02*** | (2006.01) |

(52) U.S. Cl.
CPC ..... *B44D 2/00* (2013.01); *B05D 3/007* (2013.01); *B44C 3/025* (2013.01); *B44D 3/18* (2013.01)

(58) Field of Classification Search
CPC ..... B44D 2/00
USPC ..... 427/379
See application file for complete search history.

(56) References Cited

U.S. PATENT DOCUMENTS 3,819,436 A * 6/1974 Allen ..... B44D 2/00 156/280

FOREIGN PATENT DOCUMENTS

| | | | |
|---|---|---|---|
| CN | 101830145 | * | 9/2010 |
| KR | 10-1989-0007933 A | | 7/1989 |
| KR | 10-2005-0041752 A | | 5/2005 |
| KR | 10-0585627 B1 | | 6/2006 |
| KR | 10-2006-0095537 A | | 8/2006 |
| KR | 20060095537 A | * | 8/2006 |
| KR | 10-2007-0044824 A | | 4/2007 |
| KR | 10-2009-0049170 A | | 5/2009 |
| KR | 10-2012-0025735 A | | 3/2012 |

* cited by examiner

*Primary Examiner* — Tabatha Penny
(74) *Attorney, Agent, or Firm* — Rabin & Berdo, P.C.

(57) ABSTRACT

A manufacturing method of a picture comprises, disposing salt on a manufacturing board to form a salt layer, and coating and drying steps. In the primary coating and drying steps, polyurethane resin cured by exposure to air for about 10 to 20 minutes is poured onto the salt layer and the primary coating layer is dried in a condition of a relative humidity of 40 to 60%. In the secondary coating step, polyurethane resin cured for about 21 to 40 minutes is poured onto the primary coating layer and the secondary coating layer is dried in a condition of a relative humidity of 1 to 39%. In the tertiary coating step, polyurethane resin cured for about 50 to 70 minutes is poured onto the secondary coating layer and the tertiary coating layer is dried in a condition of a relative humidity of 1 to 39%.

1 Claim, 8 Drawing Sheets

PICTURE USING SALT AND MANUFACTURING METHOD THEREFOR

TECHNICAL FIELD

The present invention relates to a picture using salt, the picture making up for the disadvantages, of salt, of having weak moisture resistance and being easily broken, by using excellent adhesive strength, waterproofness and corrosion resistance of polyurethane, thereby widening the application of salt by allowing salt to have strong moisture resistance and to be firmly adhered to a manufacturing plate; and a manufacturing method therefor.

BACKGROUND ART

According to an art market report announced by the European Fine Art Foundation, the art turnover of world art market was 470 billion euros, 68 trillion won as Korean money, in 2013 and it renewed highest value by an increase of 8 percent compared with the previous year. Thus, the Korean Ministry of Culture, Sports and Tourism has announced a goal of expanding the domestic art market by 6,300 hundred million won by 2018, which has a bright future in the home and abroad art markets.

A contemporary art is usually related to the art abandoned the past traditions in the spirit of experimentation. The contemporary art, in which the idea plays a key role, is an essential part of the global art market and a new artistic idea is of great value in itself.

An example, in that a different material other than the paints is used in the picture, is disclosed in "picture producing method using grain" (Korean Patent Laying-open No. 10-1989-0007933, Patent Document 1) including a first step of preparing the grains having various colors, defatting the color-unchangeable grains such as glutinous rice and millet etc. by using a degreasing solution, removing the degreasing solution contained in the grains by using an air circulation method, sterilizing all grains, which are defatted and not defatted, in a sterilization liquid for making them in an aseptic, and drying them all; a second step of making a rough sketch of the picture to be produced on a canvas by a design method or a printing method separately from the first step, preparing the canvas, adhering it to a rear backing plate, and then granting the adhesive; and a third step of selecting the grains for meeting the pattern and the color embedded in the canvas by using the grains prepared by the first step to be adhered in all, firstly spraying and scattering preservatives thereto, fully drying it in the shade at ambient temperature to avoid a direct sunlight, secondly conducting a waterproof and a mothproof by applying a varnish or a lacquer etc. to be completely dried, completing the desiring picture, and mounting in the frame.

As illustrated in the Patent Document 1, since the adhesives should be used for fixing the grains of the different material to the canvas and it is necessary to conduct the waterproof and the mothproof etc., there is a problem in that the processes are very complicated.

In addition, "manufacturing method of natural picture materials and picture painting method using the same (Korea Patent registration No. 10-0585627, Patent Document 2) discloses processes for manufacturing the picture materials by powdering and purifying the natural materials such as a soil.

In the Patent Document 2, it powders the natural materials, so that it can utilize only the color components of the natural ingredient itself. However, since its own quality of the material is lost, there is a problem in that it reduces the attractive as a natural art material.

On the other hand, "Manufacturing method of picture, calligraphy, and trademark using jewelry powder" (Korean Patent Laying-open No. 10-2007-0044824, Patent Document 3) discloses a technology of grinding the brilliant jewelry, sticking it on the sketch, and then heat-treating it.

In the Patent Document 3, it can provide the picture of utilizing a characteristic which is reflected by the radiance and the light having the jewelry itself. However, because it utilizes the expensive jewelry, there is a problem in that it lacks popular appeal.

Meanwhile, the salt is a condiment of salty taste in that the main component is sodium chloride (NaCl), is existed in a body fluid, and plays an important role in the maintenance of the osmotic pressure. Accordingly, it is the most important material indispensable to the human and very important material even historically and religiously regardless of all ages and cultures.

Recently, these salts have been used as new art materials of the modern Art painters. However, since there is no method of sticking the salt in its own shape and safely coating it on the water owing to the tricky nature thereof, the range of use is extremely restrictive. Accordingly, since the world famous painters utilizes it as performing arts in that it sprinkles the salts on the floor and it sweeps up the salts on the floor or preserves the picture as only the photograph after the performing arts, there is a problem in that it cannot preserve the salt picture itself.

CITATION LIST

Patent Literature 1

Korean Patent Laying-open No. 10-1989-0007933 (Jul. 6, 1989)

Patent Literature 2

Korea Patent registration No. 10-0585627 (May 25, 2006)

Patent Literature 3

Korean Patent Laying-open No. 10-2007-0044824 (Apr. 30, 2007)

DISCLOSURE

Technical Problem

A picture using salt and a manufacturing method therefor according to the invention are to solve a problem occurring in the conventional technique described above, wherein salt having solubility of being dissolved by moisture and a characteristic of being easily broken as disadvantages of salt is coated using transparent liquid synthetic resin so as not to be dissolved by moisture or damaged by impact, thereby improving reservation.

In particular, a coating layer is composed of a transparent polyurethane and a salt layer is configured to have a non-uniform height, so that it can provide a picture having a three-dimensional effect and a color tone without using a separate color material through a yellowing phenomenon of the polyurethane owing to a light in the drying process.

In addition, a plurality of coating steps and drying steps are repeated after it places the salts on a manufacturing board and the salts are dissolved to some extent through the moisture in the atmosphere by increasing the ambient humidity during the initial coating step, so that the cohesive strength between the salt particles is generated and a low-cured polyurethane having a low viscosity and a large fluidity is poured to be coated, so that it can prevent the salt layer having a non-uniform height placed on the manufacturing board from being destroyed in the coating process.

Moreover, in the following process, an intermediate-cured polyurethane having a viscosity larger than the initial polyurethane is poured to be coated in a state that the humidity in the atmosphere is lowered in comparison with the initial step, so that the dissolving of the salt layer due to the humidity is minimized and the polyurethane having a high viscosity makes the coating layer uniformly without being pushed into the low places in accordance with its height.

In particular, the manufacturing board is made of a material of transmitting the light and a lighting device is formed in the rear of the manufacturing plate, so that the contrast effect can be maximized according to the change of the light transmittance owing to the non-uniform height of the salt layer.

Technical Solution

According to one aspect of the present invention so as to accomplish these objects, there is provided to a manufacturing method of a picture using a salt includes: a disposition step of disposing salt on a manufacturing board 10 to form a salt layer 20 having an upper face with a non-uniform height; a coating step of pouring transparent liquid polyurethane onto the salt layer 20 to form a coating layer 30; and a drying step of drying the salt layer 20 on which the coating layer 30 is formed.

In this case, the synthetic resin is a polyurethane resin.

In addition, the coating step and the drying step are paired and repeated three times, and include a primary coating step, a primary drying step, a secondary drying step, a secondary coating step, a tertiary coating step, and a tertiary drying step; in the primary coating step, low-cured polyurethane resin is poured onto the salt layer to form a primary coating layer 31, in the primary drying step, the coating layer is dried for 70 to 80 hours in a condition of a relative humidity of 40 to 60%; in the secondary coating step, intermediate-cured polyurethane resin is poured onto the primary coating layer 31 that passed through the primary drying step to form a secondary coating layer 32, in the secondary drying step, the coating layer is dried for 67 to 77 hours in a condition of a relative humidity of 1 to 39%; in the tertiary coating step, intermediate-cured polyurethane resin is poured onto the secondary coating layer passing through the secondary drying step to form a tertiary coating layer 33, and in the tertiary drying step, the coating layer is dried for 67 to 77 in a condition of a relative humidity of 1 to 39%.

The picture using salt according to the present invention includes: a manufacturing board 10; a salt layer 20 which is disposed on the manufacturing board 10 to have an upper face with a non-uniform height; and a coating layer 30 which is formed by applying and coating transparent synthetic resin onto the salt layer 20.

In this case, the manufacturing board 10 is made of a material that allows light to pass and further includes a case 40 which is installed below the manufacturing plate 10 and a lighting device 50 which is installed in the case 40 and irradiates the manufacturing board 10 with light.

Advantageous Effects

According to the present invention, the salt having solubility of being dissolved by moisture and the characteristic of being easily broken as disadvantages of salt is coated using transparent liquid synthetic resin so as not to be dissolved by moisture or damaged by impact, thereby improving reservation.

In particular, a coating layer is composed of a transparent polyurethane and a salt layer is configured to have a non-uniform height, so that it can provide a picture having a three-dimensional effect and a color tone without using a separate color material through a yellowing phenomenon of the polyurethane owing to a light in the drying process.

In addition, a plurality of coating steps and drying steps are repeated after it places the salts on a manufacturing board and the salts are dissolved to some extent through the moisture in the atmosphere by increasing the ambient humidity during the initial coating step, so that the cohesive strength between the salt particles is generated and a low-cured polyurethane having a low viscosity and a large fluidity is poured to be coated, so that it can prevent the salt layer having a non-uniform height placed on the manufacturing board from being destroyed in the coating process.

Moreover, in the following process, an intermediate-cured polyurethane having a viscosity larger than the initial polyurethane is poured to be coated in a state that the humidity in the atmosphere is lowered in comparison with the initial step, so that the dissolving of the salt layer due to the humidity is minimized and the polyurethane having a high viscosity makes the coating layer uniformly without being pushed into the low places in accordance with its height.

In particular, the manufacturing board is made of a material of transmitting the light and a lighting device is formed in the rear of the manufacturing plate, so that the contrast effect can be maximized according to the change of the light transmittance owing to the non-uniform height of the salt layer.

BRIEF DESCRIPTION OF DRAWINGS

The above and other objects, features and advantages of the present invention will be more apparent from the following detailed description taken in conjunction with the accompanying drawings, in which.

REFERENCE SIGNS LIST

Figure 1:
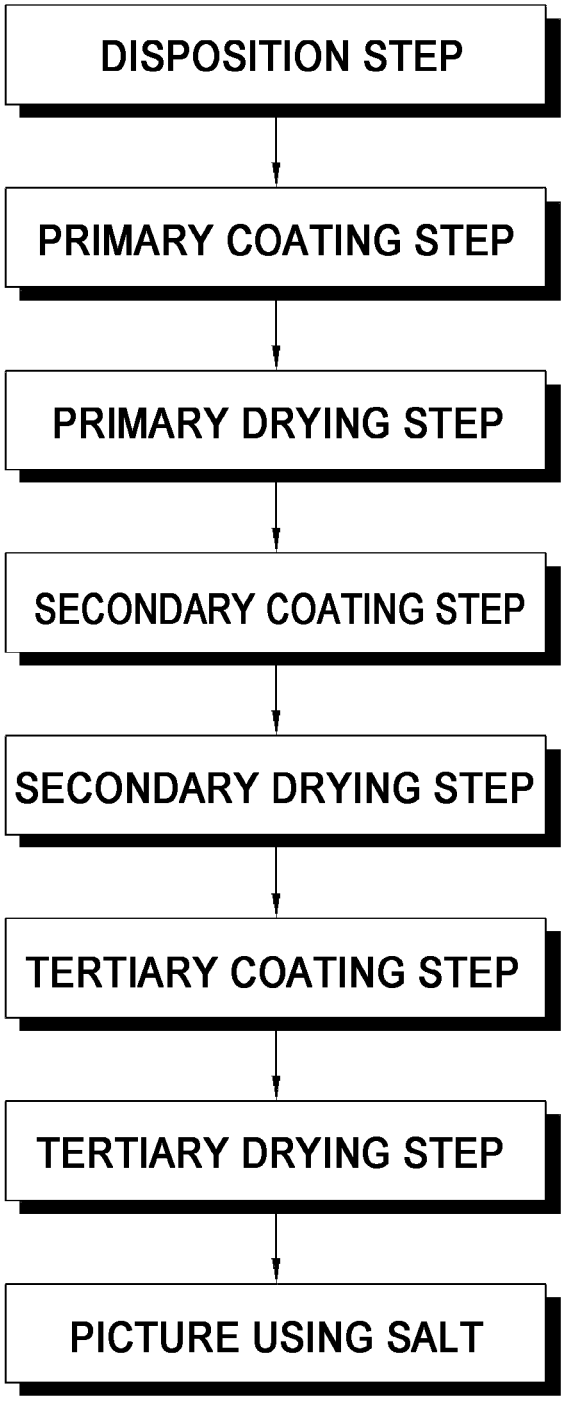
FIG. 1 is a flow chart showing a manufacturing process of a picture using a salt according to the present invention.

10: manufacturing board
20: salt layer
30: coating layer

31: primary coating layer
32: secondary coating layer
33: tertiary coating layer
40: case
50: lighting device

BEST MODE

Mode for Invention

Hereinafter, a picture using salt and a manufacturing method therefor according to the invention will be described in detail with reference to the accompanying drawings and pictures.

The manufacturing method of a picture using salt mainly includes a disposition step, a coating step, and a drying step.

1. Disposition Step

Figure 2:
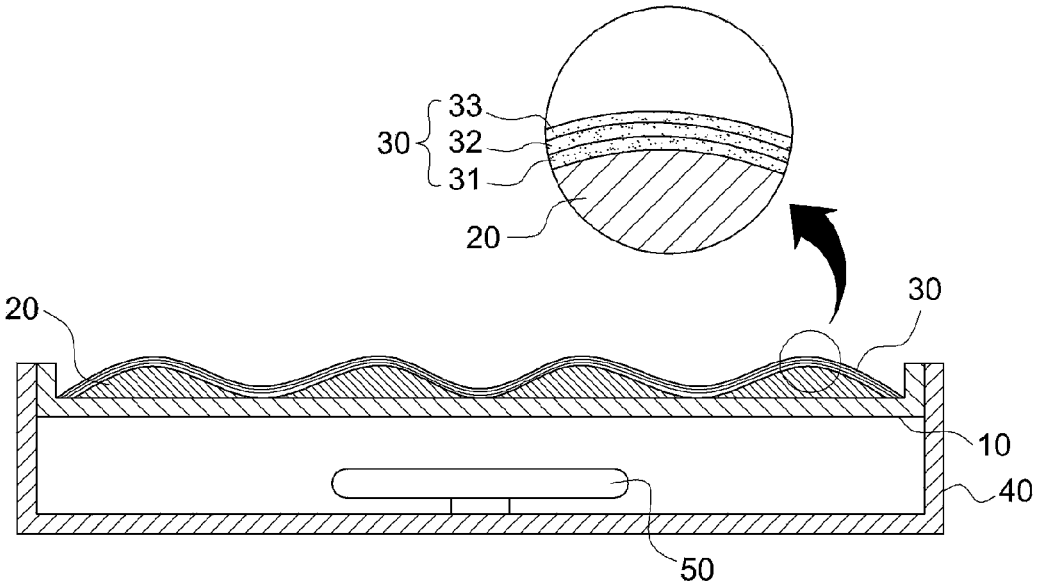
FIG. 2 is a cross-sectional view showing one embodiment of a picture using a salt according to the present invention.
Figure 3:
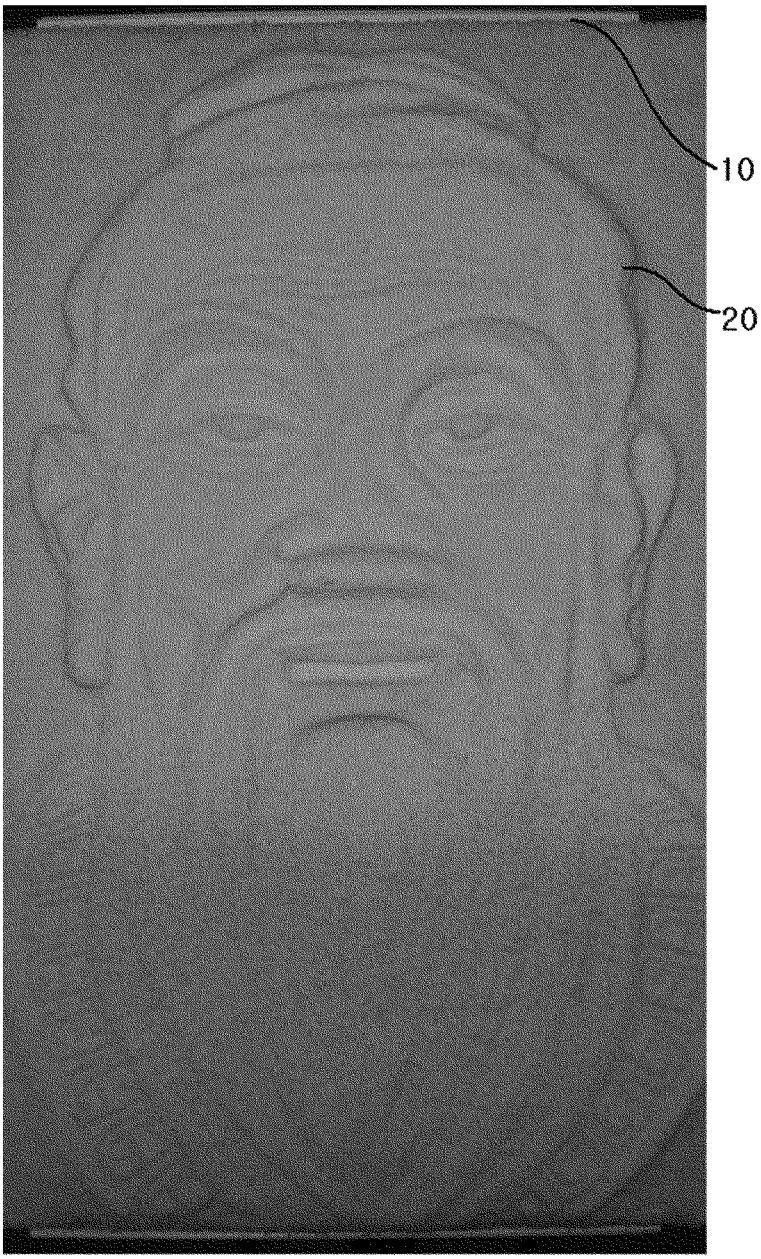
FIG. 3 is a photograph showing a salt layer in that Disposition step is completed in the present invention.

In the disposition step, as illustrated in FIG. 2 and FIG. 3, salt is disposed on a manufacturing board 10 such as canvas to be a picture desired by a producer, to form a salt layer 20 having an upper face with a non-uniform height.

In this case, the reason why the upper face has the non-uniform height is that the salt is put and disposed on the entire of the manufacturing board 10 and then form a picture by crossing the salt with a stick or a finger as performed in conventionally known performing arts.

However, in such a manner, it is difficult to create a precise and elaborate picture such as a portrait like the illustrated picture.

Furthermore, it is more difficult that an elaborate picture has even a shading effect.

Accordingly, a preferable manner for drawing a precise picture is that salt is individually disposed on the manufacturing board 10 by using means such as tweezers, the salt is allowed to form a plurality of layers at a part where an effect of shading is to be raised, and a salt layer 20 having an upper face with a non-uniform height is formed.

When a worker does not perform handwork, salt may be disposed by using the known various robot arms.

In this case, it is preferable that the manufacturing board 10 is made of a material having a property of allowing light to entirely pass or partially pass instead of an opaque material.

For example, the manufacturing board may be made of a transparent or white acrylic plate or the like, and most preferably, may be formed of a transparent acrylic plate.

In addition, in such a disposition step, in order to prevent the salt disposed on the manufacturing board 10 from being dissolved by moisture in the air, it is preferable that ambient humidity in the disposition step is equal to or less than a relative humidity of 30%.

2. Coating Step

Liquid transparent synthetic resin is poured onto the salt layer 20 to form a coating layer 30.

As the liquid transparent synthetic resin, the known various products may be used.

When high-temperature resin in a molten state at the room temperature is used, the salt layer 20 may be damaged by heat, and it is preferable to use resin which is liquid at the room temperature.

Kinds of resin which is liquid at the room temperature and is transparent are epoxy resin and polyurethane resin.

The epoxy resin generally called resin has a transparent state in a sealed liquid state, but the transparency is lowered after the resin is exposed to the air and then cured, and particularly, the resin generates heat in the course of curing and may thermally damage the salt layer 20.

Meanwhile, the polyurethane resin has excellent transparency after curing as compared with the epoxy resin, and particularly, less heat is generated in the course of curing and thus does not thermally damage the salt layer 20.

Accordingly, as the liquid transparent synthetic resin, it is most preferable to use the transparent liquid polyurethane resin.

Figure 4:
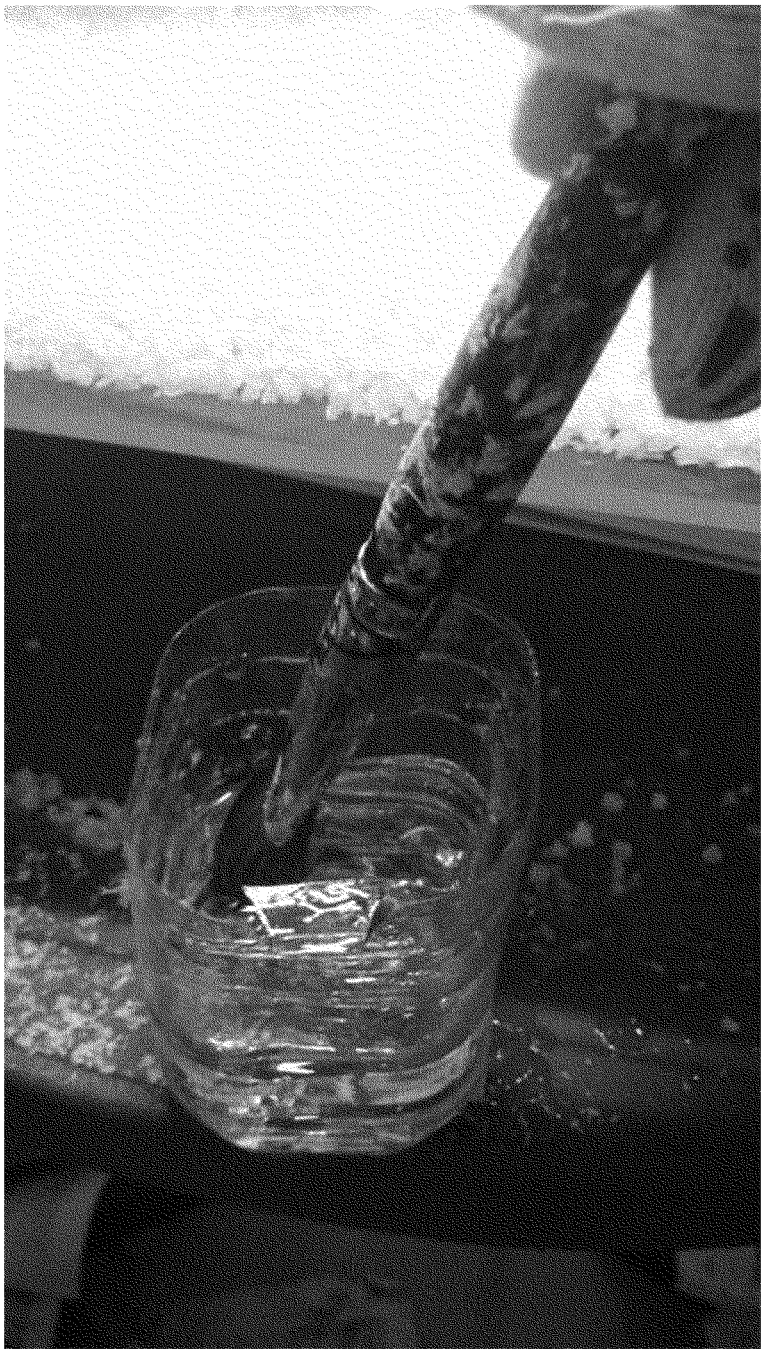
FIG. 4 is a photograph showing a state in that a brush is immersed in a polyurethane resin of a transparent liquid so as to carry out a coating in the present invention.
Figure 5:
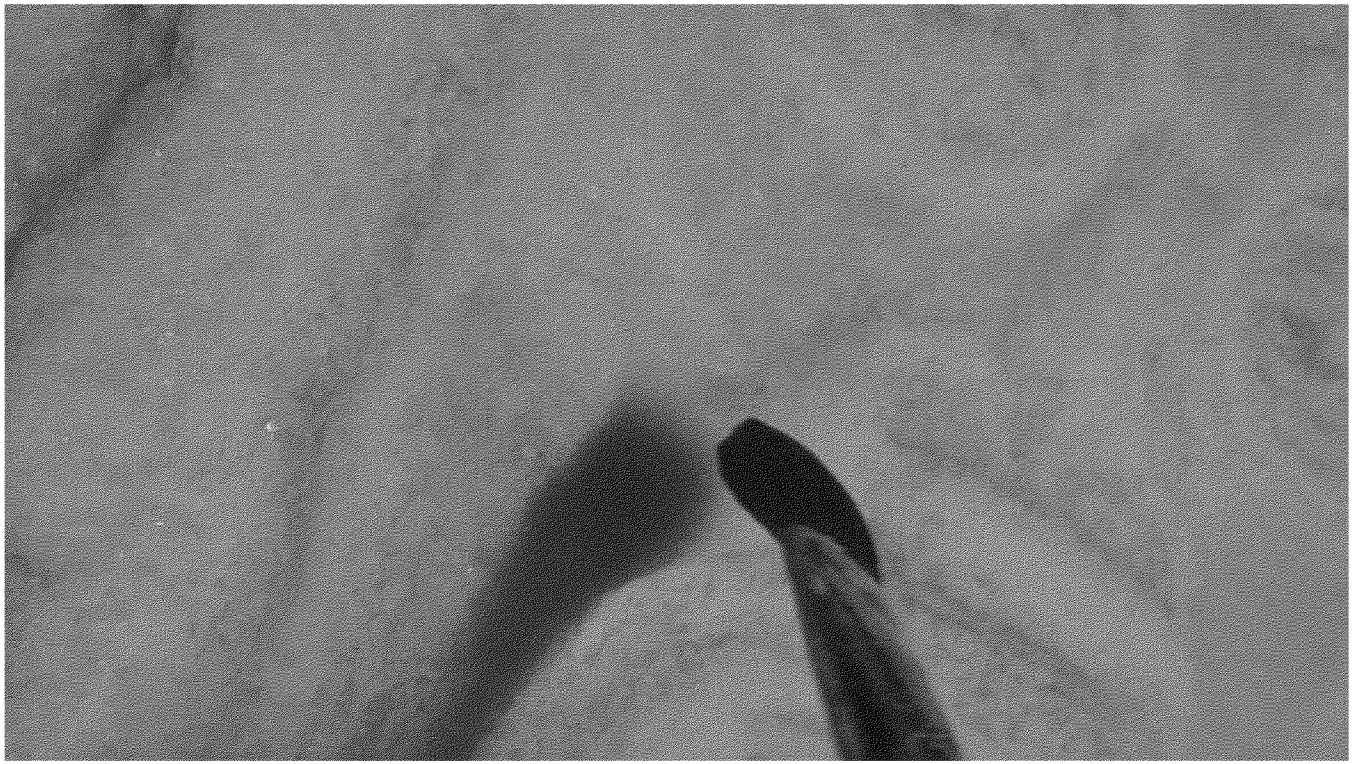
FIG. 5 is a photograph showing a state that a coating layer is formed by dropping the polyurethane with a brush after the step of FIG. 4.

An embodiment of the coating step is illustrated in FIG. 4 and FIG. 5.

When the worker performs handwork, as illustrated in FIG. 4, a brush is dipped in polyurethane resin contained in a container and the resin is dropped onto the salt layer 20 disposed on the manufacturing board 10 or the salt layer 20 is touched with the brush to perform coating.

As a method of coating in a mechanical manner, the manufacturing board 10 on which the salt layer 20 is formed in a chamber is installed, and polyurethane resin is supplied thereon by spraying through a nozzle or the like to perform coating.

In this case, it is preferable to reduce the pressure applied at the time of spraying so as not to change the air flow in the chamber or the shape of disposing the salt layer 20 by the pressure of the sprayed polyurethane resin.

3. Drying Step

The salt layer 20 on which the coating layer 30 is formed is dried to manufacture a picture using salt according to the invention.

As the drying manner, it is more preferable that the manufacturing board 10 on which the coating layer 30 and the salt layer 20 are formed is positioned in a room or a drying furnace where relative humidity is low for drying instead of a hot-air drying method.

In the configuration described above, the coating step and the drying step may be finished as one continuous process.

However, in the salt layer 20 formed in the disposition step, cohesion among salt particles is weak because a separate adhesive is not used among the salt particles, and the salt layer 20 may be easily fallen even when small impact is applied thereto.

In order to form the coating layer 30 while preventing the salt layer 20 from being fallen, the polyurethane resin has to be coated at very low pressure.

In another aspect, only if the coating layer 30 is formed with a predetermined thickness on the salt layer 20 having the upper face with a non-uniform level, an effect based on transmission of light constantly occurs. In order to form the coating layer with the predetermined thickness, the liquid polyurethane resin has to be coated in a relatively high viscosity and then has to be immediately dried.

However, when the polyurethane resin in the high viscosity state is coated directly on the salt layer 20, the salt layer 20 with weak cohesion among particles is fallen and loses the shape.

Accordingly, it is preferable to repeat the coating step and the drying step several times in different conditions considering the cohesion among salt particles and the viscosity of polyurethane resin.

As a specific example, the coating step and the drying step are paired and repeated three times, and may be configured with a primary coating step, a primary drying step, a secondary drying step, a secondary coating step, a tertiary coating step, and a tertiary drying step.

In the primary coating step, low-cured polyurethane resin is poured onto the salt layer to form a primary coating layer 31.

As the low-cured polyurethane resin, commercially available polyurethane resin with low viscosity in a sealed state is exposed to the air for about 10 to 20 minutes to be low cured and is applied onto the salt layer 20 in a low viscosity state as compared with the secondary coating step to be described later, to perform coating.

When the primary coating layer 31 is formed by using the low-cured polyurethane resin with low viscosity as described above, it is possible to prevent the salt layer 20 with weak cohesion among particles from being fallen because the viscosity of the polyurethane resin is low in the course of coating.

In the primary drying step, the salt layer 20 on which the primary coating layer 31 is formed is dried for 70 to 80 hours in a condition of a relative humidity of 40 to 60%.

The relative humidity condition described above is a high humidity state as compared with the secondary drying step to be described later. In this state, moisture among the salt particles is higher than that of the subsequent process, and the salt particles are finely dissolved by the moisture to have cohesion to each other.

In other words, the curing is performed while the salt layer 20 is not fallen in the state where the coating layer 31 is formed.

In the secondary coating step, intermediate-cured polyurethane resin is poured onto the primary coating layer 31 that passed through the primary drying step to form a secondary coating layer 32.

The intermediate-cured polyurethane resin is in a high viscosity state as compared with the primary coating step described above, by exposing sealed polyurethane resin with low viscosity for 21 to 40 minutes to the air such that curing is further actively performed as compared with the primary coating step.

In this case, less change in shape of the salt layer 20 occurs by the primary drying step already. According to the coating of the polyurethane resin with high viscosity, the polyurethane resin flows to a low level place in accordance with the height of the level of the salt layer 20 and is hardened, and the thickness of the coating layer is prevented from being non-uniform.

In the secondary drying step, the coating layer is dried for 67 to 77 hours in a condition of a relative humidity of 1 to 39% lower than that of the primary drying step.

The reason why the humidity is lowered is that moisture is maximally removed from the salt layer 20 and the coating layer to prevent the salt from being dissolved by the moisture in the state where the manufacturing of the picture is completed.

In the tertiary coating step, the polyurethane resin is exposed to the air to further raise the viscosity as compared with the secondary coating step. After 50 to 70 minutes elapse, the coating process is performed by using the polyurethane resin, and a finishing process is performed such that the overall thickness of the coating layer is uniform.

In the tertiary drying step, the coating layer is dried for 67 to 77 hours in a condition of a relative humidity of 1 to 39%.

When a plurality of coating and drying processes are repeated in the conditions described above, moisture in the salt layer 20 is minimized, and it is possible to maximally prevent the salt layer 20 from being deformed in shape by moisture.

In addition, even in the course of coating the liquid polyurethane, it is possible to maximally prevent the salt layer 20 from being deformed in shape.

In addition, the entire thickness of the coating layer 30 can be uniform, and it is possible to satisfactorily keep the intent to adjust the transmittance of light with differences in level on the upper face of the salt layer 20.

As illustrated in FIG. 2, the picture using salt according to the present invention manufactured by the manufacturing method described above includes: a manufacturing board 10; a salt layer 20 which is disposed on the manufacturing board 10 to have an upper face with a non-uniform height; and a coating layer 30 which is formed by applying and coating transparent synthetic resin onto the salt layer 20.

Figure 6:
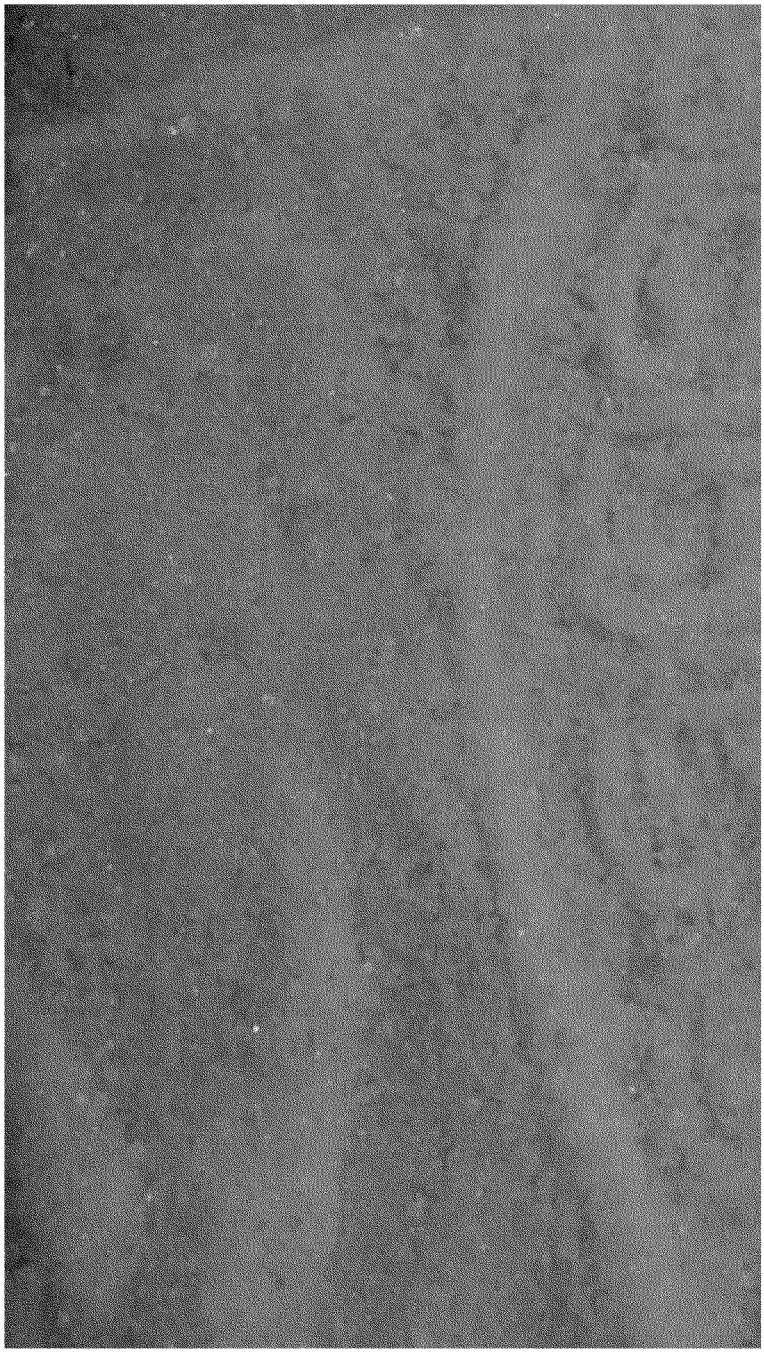
FIG. 6 is a photograph showing a state in which the formation of the coating layer is completed.
Figure 7:
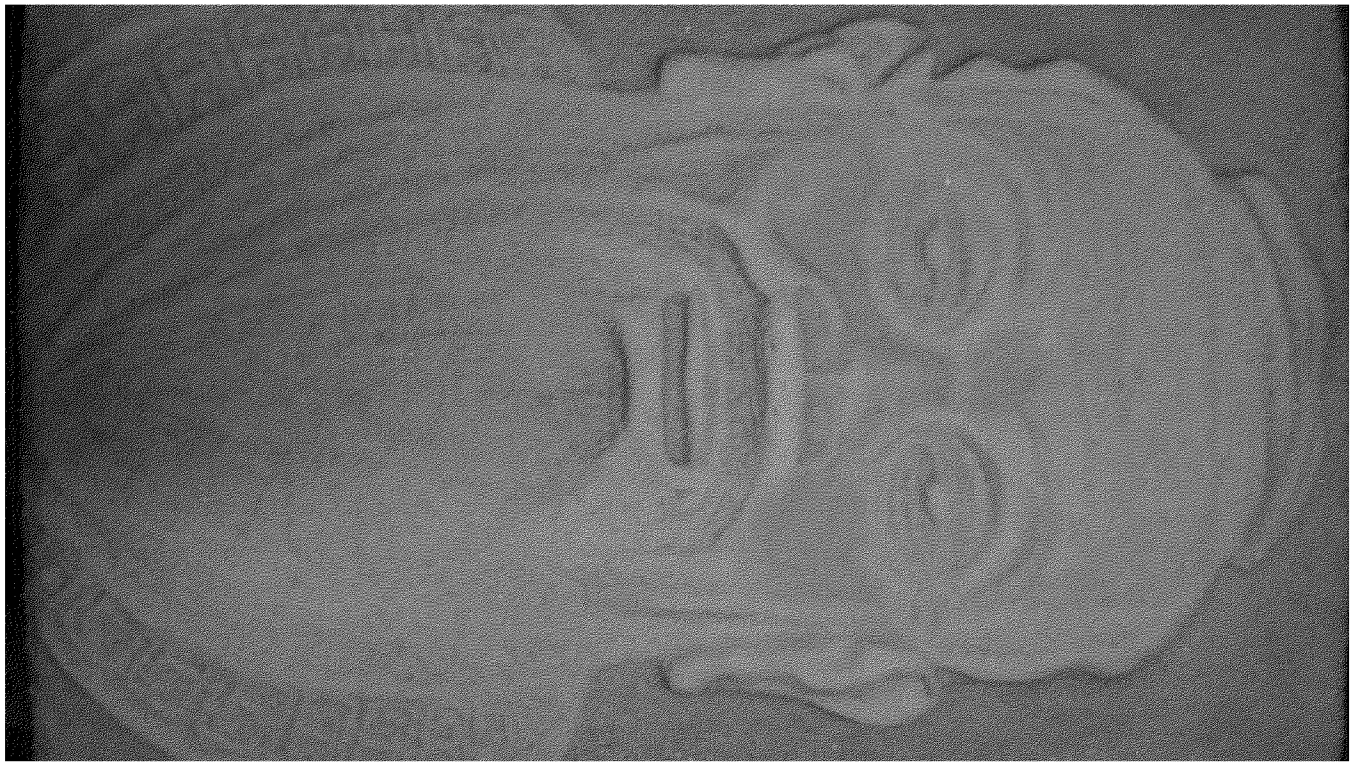
FIG. 7 is a photograph showing an example of a picture using a salt according to the present invention.

The completely manufactured picture is illustrated in FIG. 6 and FIG. 7.

It seems that the picture illustrated in FIG. 6 and FIG. 7 is discolored as compared with the picture in which only the salt layer 20 illustrated is formed in FIG. 3.

The polyurethane is exposed to ultraviolet light in the drying step to cause a yellowing phenomenon, thereby resulting in discoloration.

In other words, the picture has a color by adjusting an exposure degree of ultraviolet light in the drying step as compared with colorlessness illustrated in FIG. 3, and to allow a person seeing the picture to feel another color tone.

In the picture using salt according to the invention configured as described above, a property of salt which allows light to pass is utilized by using the transparent liquid resin, and a lot of salt is laminated to partially adjust the transmittance of light. When the manufacturing board 10 is embodied with a transparent acrylic plate or the like, a peculiar aesthetic is provided when being irradiated with light from the back side to the front side.

Specifically, the manufacturing board 10 is made of a material that allows light to pass and further includes a case 40 which is installed below the manufacturing plate 10 and a lighting device 50 which is installed in the case 40 and irradiates the manufacturing board 10 with light.

The lighting device 50 may be an LED lamp having various colors.

Figure 8:
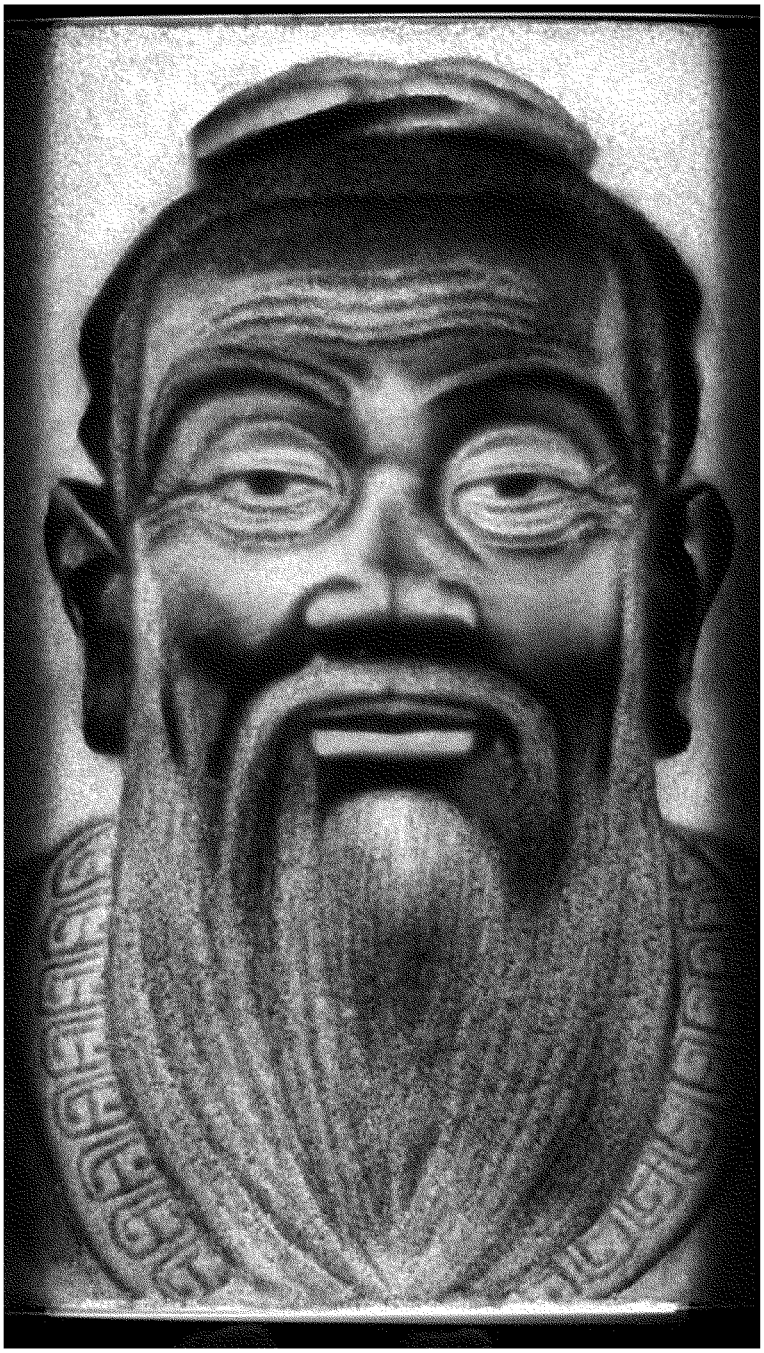
FIG. 8 is a photograph showing a state in that the light is irradiated by using a lighting device after the lighting device and the case are additionally provided in the drawing of FIG. 7.

FIG. 8 illustrates the picture of the invention in a state where the lighting device 50 and the case 40 are installed.

As compared with the picture of FIG. 3 and the picture of FIG. 7, shading is exactly shown by the salt layer 20 disposed to have level difference. Light is allowed to partially pass according to characteristics of salt and transparent resin so that the picture can provide higher aesthetic.

INDUSTRIAL APPLICABILITY

The picture using salt according to the invention configured as described above and the manufacturing method therefor may be used as various sculptures as well as pictures.

What is claimed is:

1. A manufacturing method of a picture comprises:

a disposition step of disposing salt on a manufacturing board to form a salt layer having an upper face with a non-uniform height;

a coating step of pouring transparent liquid polyurethane onto the salt layer to form a coating layer; and a drying step of drying the salt layer on which the coating layer is formed, wherein the coating step and the drying step are paired and repeated three times, and include a primary coating step, a primary drying step, a secondary coating step, a secondary drying step, a tertiary coating step, and a tertiary drying step, in the primary coating step, polyurethane resin cured by exposure to air for about 10 to 20 minutes is poured onto the salt layer to form a primary coating layer, in the primary drying step, the primary coating layer is dried for 70 to 80 hours in a condition of a relative humidity of 40 to 60%, in the secondary coating step, polyurethane resin cured by exposure to air for about 21 to 40 minutes is poured onto the primary coating layer that passed through the primary drying step to form a secondary coating layer, in the secondary drying step, the secondary coating layer is dried for 67 to 77 hours in a condition of a relative humidity of 1 to 39%, in the tertiary coating step, polyurethane resin cured by exposure to air for about 50 to 70 minutes is poured onto the secondary coating layer that passed through the secondary drying step to form a tertiary coating layer, and in the tertiary drying step, the tertiary coating layer is dried for 67 to 77 hours in a condition of a relative humidity of 1 to 39%.

* * * * *